US006918792B2

(12) United States Patent
Hu et al.

(10) Patent No.: US 6,918,792 B2
(45) Date of Patent: Jul. 19, 2005

(54) MEMORY CARD CONNECTOR

(75) Inventors: Jinkui Hu, Kunsan (CN); ZiQiang Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/994,787

(22) Filed: Nov. 22, 2004

(65) Prior Publication Data

US 2005/0118877 A1 Jun. 2, 2005

(30) Foreign Application Priority Data

Nov. 29, 2003 (CN) ..... 200320120134 U

(51) Int. Cl.[7] ..... H01R 24/00
(52) U.S. Cl. ..... 439/630
(58) Field of Search ..... 439/60, 83, 630, 439/631, 541.5, 924.1

(56) References Cited

U.S. PATENT DOCUMENTS 6,579,126 B2 * 6/2003 Narumo et al. ..... 439/630
6,607,405 B2 8/2003 Nishimura
6,749,450 B1 * 6/2004 Chen ..... 439/188
6,814,622 B1 * 11/2004 Lai et al. ..... 439/631
6,857,907 B1 * 2/2005 Hung et al. ..... 439/630

* cited by examiner

*Primary Examiner*—Thanh-Tam Le
(74) *Attorney, Agent, or Firm*—Wei Te Chung

(57) ABSTRACT

A memory card connector (100) adapted for receiving at least different cards includes an insulative housing (1), a plurality of front terminals (3) and a plurality of rear terminals (2). The housing defines a receiving room (14) for receiving at least two different cards. The front and rear terminals both include contacting portions (2*d*, 3*d*) extending into the receiving room. The memory card connector includes a pair of spring fingers (4) for protecting the front terminals being excessively contacted by an inserted card. The height of the spring fingers is higher than that of the front terminals.

5 Claims, 5 Drawing Sheets

MEMORY CARD CONNECTOR

BACKGROUND OF THE INVENTION

1. Field of the Invention

The present invention relates to a card connector mounted to electronic appliances such as portable telephones, personal digital assistance (PDA), portable audio, cameras and the like, more particularly to a card connector which can be loaded simultaneously with at least two cards of different types differing in outer shape, contact pad position or the like.

2. Description of the Prior Art

With electronic appliances such as portable telephones, personal digital assistances (PDA), cameras and the like being used widely, more demands are brought. Various functional expansions are achieved by mounting IC cards such as subscriber identity module (SIM), multimedia card (MMC), smart media card (SM), memory stick (MS), super density secure digital card (SD), xD-picture card (xD) and the like. As a result, a card connector is in demand that can be loaded with cards of a plurality of different types simultaneously so that the electronic appliances can be. operative with cards of a plurality of types. U.S. Pat. No. 6,607,405 B2 discloses a memory card connector capable of containing two types of cards. The conventional connector includes an insulative housing having an upper slot for containing a first card and a lower slot for containing a second card. The upper slot is spaced from the lower slot by a planar partition. A plurality of first contact terminals are brought into contacting with the first card and a plurality of second contact terminals are brought into contacting with the second card.

However, the planar partition adopted in the conventional memory card connector inevitably increases an integral height of the insulative housing. If the planar partition is not adopted, when the second card is inserted into the second slot, the second card tends to contact with the first contact terminals. Therefore, the first contact terminals are easily to be damaged.

Hence, an improved memory card connector incorporating electrical cards of different types and providing good signal transmitting quality is desired to overcome the foregoing shortcomings.

BRIEF SUMMARY OF THE INVENTION

A main object of the present invention is to provide a memory card connector having a simple structure and a relative longer life-span.

To attain the above object, a memory card connector adapted for receiving at least two different cards according to the present invention includes an insulative housing, a plurality of front terminals and a plurality of rear terminals. The housing defines a receiving room for receiving at least two different cards. The front and rear terminals both includes contacting portions extending into the receiving room. The memory card connector includes a pair of spring fingers for protecting the front terminals fixed in the insulative housing. In a free station, the height of the spring fingers is higher than that of the front terminals.

Other objects, advantages and novel features of the invention will become more apparent from the following detailed description when taken in conjunction with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE INVENTION

In the following description, it take a memory stick (MS) card and a xD-Picture card (xD) as examples in the memory card connector 100 according to the present invention. However, it is understood that other cards also can be inserted into the memory card connector.

Figure 3:
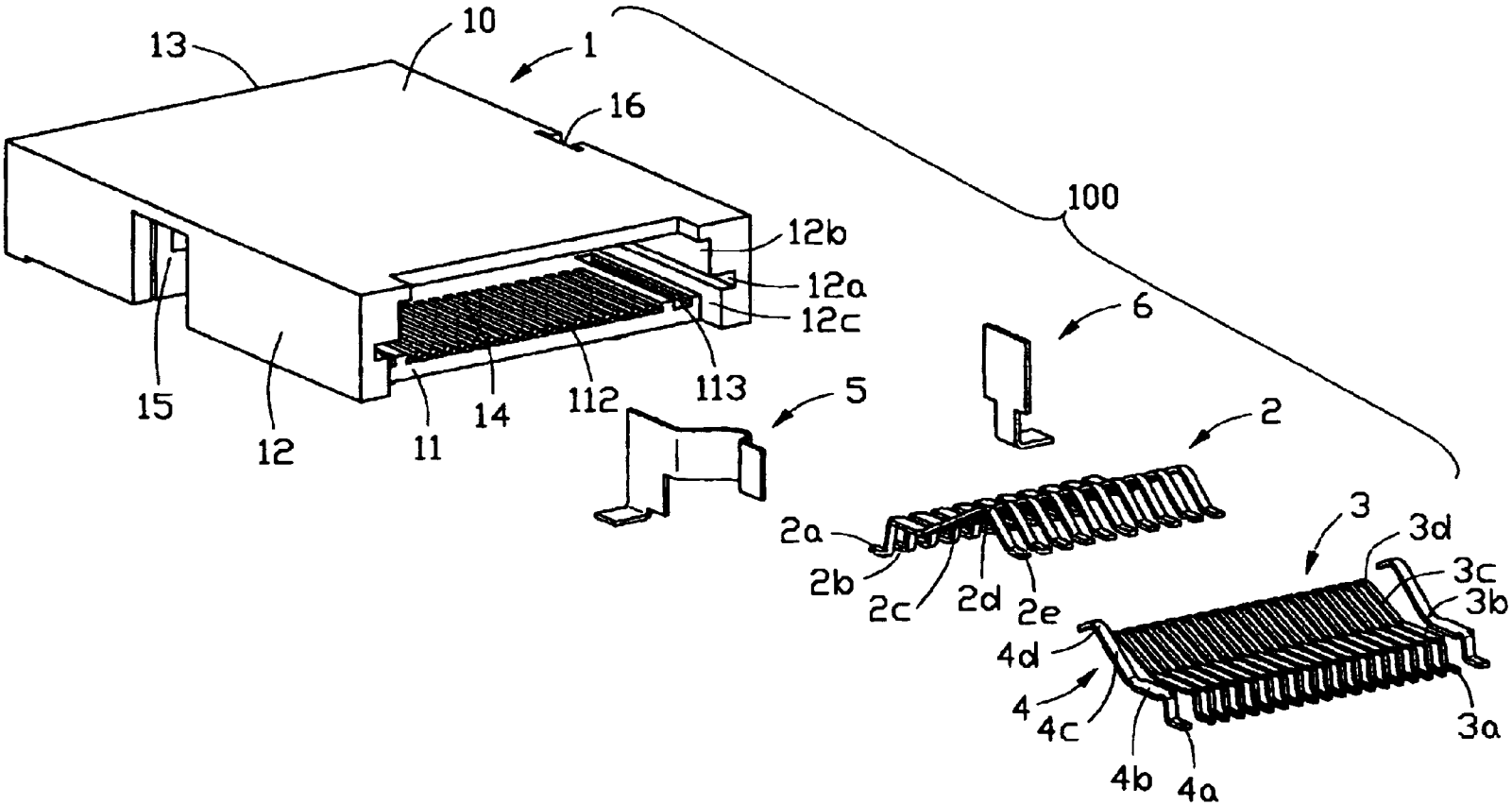
FIG. 3 is an exploded view of the memory card connector.

Referring to FIG. 3, a memory card connector according to the present invention includes an insulative housing 1, a plurality of rear conductive terminals 2 for electrically connecting with the MS card, a plurality of front conductive terminals 3 for electrically connecting with the xD card, a pair of spring fingers 4, a fixing arm 5 and a soldering tab 6.

Figure 1:
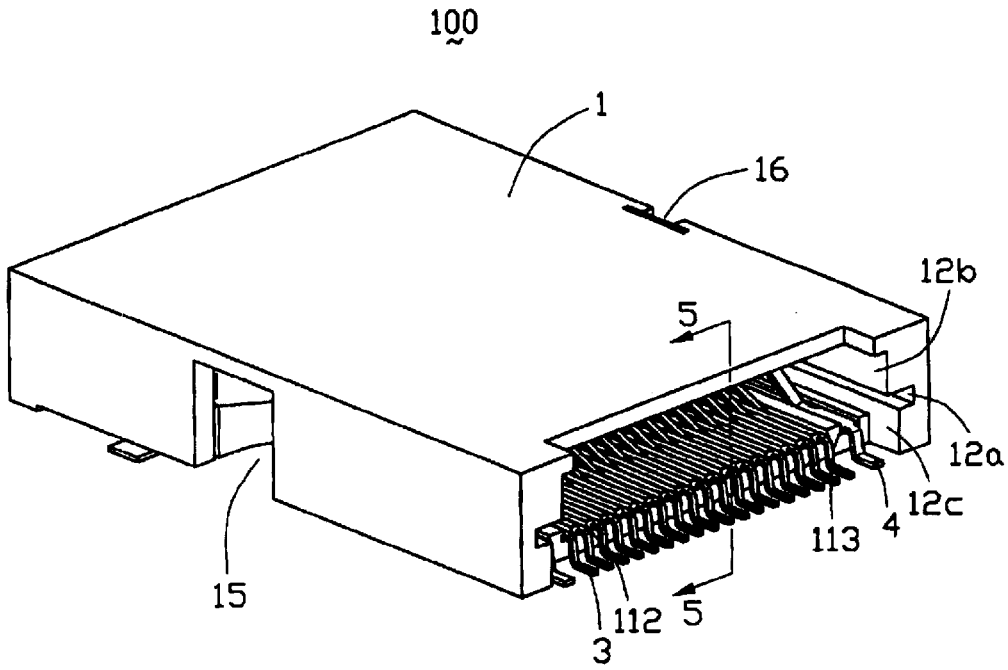
FIG. 1 is a perspective view of a memory card connector according to the present invention.
Figure 2:
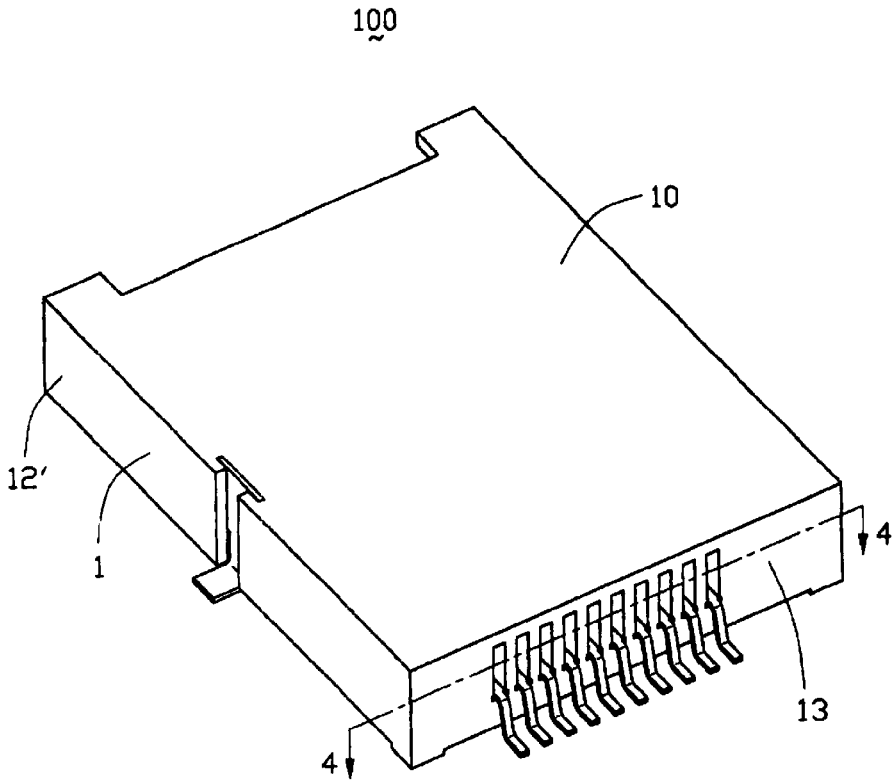
FIG. 2 is another perspective view of the memory card connector.
Figure 5:
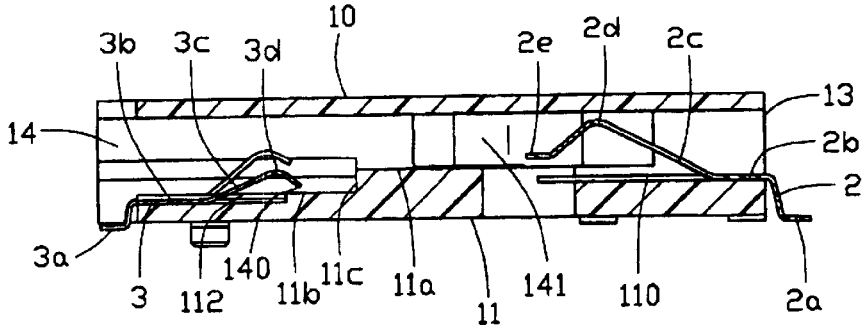
FIG. 5 is another cross sectional view taken from B—B line of FIG. 1.

Referring to FIGS. 2–3 in conjunction with FIG. 5, the insulative housing 1 includes a top wall 10, a bottom wall 11, a pair of side walls 12 and a rear wall 13. A receiving room 14 confined by the above walls 10, 11, 12 and 13 is defined in the housing 10. A slot 12*a* is defined in an inner surface of each side wall 12, thereby forming a leading face 12*b* and a connecting face 12*c*. Opposite side walls 12 respectively define a substantially U-shaped first through hole 15 and a second through hole 16 in outside surfaces thereof. The bottom wall 11 forms a substantially step shaped inner surface. The inner surface includes an upper surface 11*a*, a lower surface 11*b* and a conjunction surface 11*c* connecting the upper and lower surfaces 11*a*, 11*b*. The receiving room 14 consists of a front receiving cavity 140 and a rear receiving cavity 141. The front receiving cavity 140 is defined by the lower surface 11*b*, the slots 12*a*, the side walls 12 and the conjunction surface 11*c*. The rear receiving cavity 141 is defined by the upper surface 11*a*, the top wall 10 and the leading face 12*b*. The bottom wall 11 defines an array rear passageways 110 for receiving the rear terminals 2 through the rear wall 13. The bottom wall 12 further defines an array front passageways 112 for receiving the front terminals 3. A pair of grooves 113 for receiving the spring fingers 4 is defined opposite sides of the front passageways 112.

Referring to FIG. 3 in conjunction with FIG. 5, each rear terminal 2 includes a first soldering portion 2*a*, a first fixing portion 2*b* upwardly bending and extending horizontally from the first soldering portion 2*a*, a first spring portion 2*c* upwardly bending and extending with a angle from the fixing portion 2*b*, a first contacting portion 2*d* for contacting with the MS card formed on a top portion of the spring portion 2*c* and a tail portion 2*e* extending along the contacting portion 2*d* and horizontally bending.

Each front terminal 3 includes a second soldering portion 3*a*, a second fixing portion 3*b* upwardly bending and extending horizontally from the second soldering portion 3*a*, a second spring portion 3*c* upwardly bending and extending with a angle from the fixing portion 3*b*, a first contacting portion 3*d* for contacting with the xD card formed on a top portion of the spring portion 3*c*.

Each spring finger 4 includes a third soldering portion 4*a*, a third fixing portion 4*b* upwardly bending and extending horizontally from the third soldering portion 4*a*, a third spring portion 4*c* upwardly bending and extending with a angle from the fixing portion 4*b*, a first contacting portion 4*d* for providing supporting to the xD card or MS card formed on a top portion of the spring portion 4*c*.

The fixing arm 5 is received in the first through hole 15 and the soldering tab 6 is received in the second through hole 16.

Figure 4:
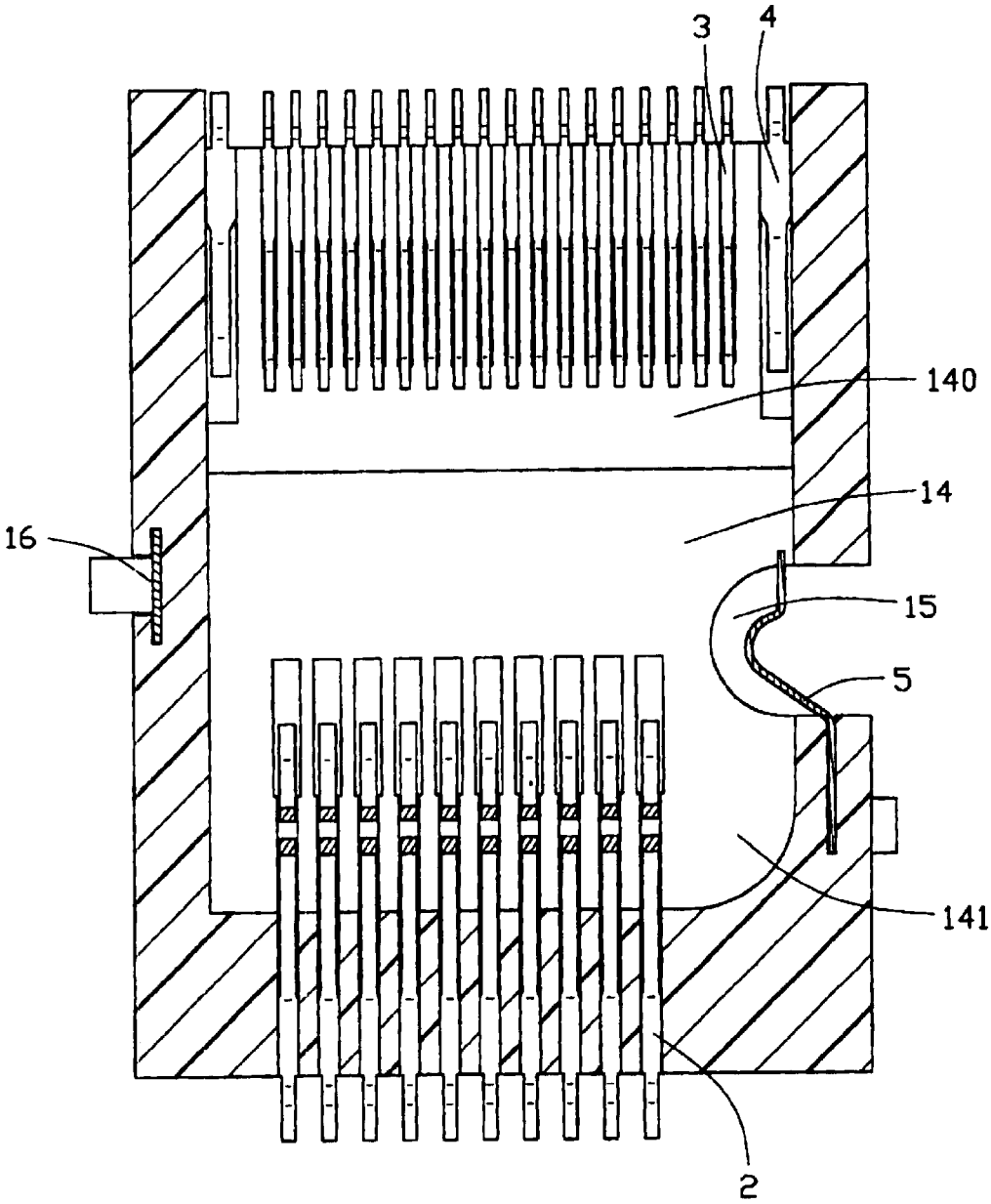
FIG. 4 is a cross sectional view taken from A—A line of FIG. 2.

Referring to FIGS. 3–5, in assembly, the first fixing portions 2*b* of the rear terminals 2, the second fixing portions 3*b* of the front terminals 3 and the third fixing portions 4*b* of the spring fingers 4 respectively are assembled in the rear passageways 110, the front passageways 112 and the grooves 113. The first soldering portions 2*a* of the rear terminals 2, the second soldering portions of the front terminals 3 and the third soldering portions of the spring fingers 4 are soldered to a printed circuit board (not shown). As a result, the first spring portions 2*c* and the contacting portions 2*d* of the rear terminals 2 are positioned in the rear receiving cavity 141 of the housing 1. The second spring portions 3*c* and the contacting portions 3*d* of the front terminals 3, the third spring portions 4*c* and the third contacting portions 4*d* of the spring fingers 4 are positioned in the front receiving cavity 140. The contacting portions 4*d* of the spring fingers is higher than the second contacting portions 3*d* of the front terminals. The spring fingers 4 have a size greater than that of the front terminals 3, thereby increasing the intensity of the spring fingers 4.

Referring to FIGS. 1–5, in use, the xD card is inserted into the housing 1, the xD card is inserted into the front receiving cavity 140 along the slots 12*a* of the housing 1 and abuts against the conjunction surface 11*c*. At the same time, the xD card contacts with the front terminals 3 and the spring fingers 4. The second soldering portions 3a and the second contacting portions 3*d* of the front terminals 3 respectively connect with the printed circuit board and the xD card, thereby forming electrical connection between the front terminals 3 and the printed circuit board.

The MS card is inserted into the housing 1, the MS card is inserted into the rear receiving cavity 141 along the leading face 12*a*. The MS card first of all contacts with the third contacting portions 4*d* of spring fingers 4, therefore the spring fingers 4 support the MS card so that the MS card does not contact with the front terminals 3. The front terminals 3 do not be damaged when the MS card is inserted into the housing 1. When the MS card connects with the rear terminals 2, the tail portions 2*e* of the rear terminals 2 are pressed into the rear passageways 110, at the same time, the spring fingers 4 provides an upward force to the MS card, therefore the MS card can get a good orientation.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A memory card connector for connecting with at least two different cards comprising:

an insulative housing including a receiving cavity for receiving at least two different cards;

a plurality of front terminals and a plurality of rear terminals retained in the housing, the plurality of front and rear terminals both including contacting portions extending into the cavity and contacting with cards; and a pair of spring fingers for protecting the front terminals from being excessively contacted by the cards, the height of the spring fingers being higher than the front terminals in a free state;

wherein the insulative housing included a top wall, a bottom wall,a pair of side walls and a rear wall, wherein an inner side of each side wall defining a slot thereby forming a leading face and a connecting face, and wherein the slot is defined between the leading face and the connecting face;

wherein the receiving cavity including a front receiving cavity and a rear receiving cavity;

wherein the bottom wall including an upper surface, a lower surface and a conjunction surface for connecting the upper and lower surfaces;

wherein the front receiving cavity is defined by the lower surface, the conjunction surface of the bottom wall and the slots of the side walls, and wherein the front terminals are positioned in the front receiving cavity; and wherein the rear receiving is defined by the top wall, the rear wall, the leading face of the each side wall and the upper surface of the bottom wall, and wherein the rear terminals are positioned in the rear receiving cavity.

2. The memory card connector according to claim 1, wherein each of the spring fingers is positioned in opposite sides of the front terminals.

3. The memory card connector according to claim 1, wherein each of the spring finger having a size greater than the front terminals.

4. The memory card connector according to claim 1, wherein the receiving cavity is defined by the top, bottom, side and rear walls.

5. The memory card connector according to claim 1, wherein the front terminals, the rear terminals and the spring fingers are assembled in the bottom wall of the housing.

* * * * *